US009746822B2

(12) United States Patent
Matsuura

(10) Patent No.: US 9,746,822 B2
(45) Date of Patent: Aug. 29, 2017

(54) IMAGE FORMING APPARATUS

(71) Applicant: Hiroki Matsuura, Kanagawa (JP)

(72) Inventor: Hiroki Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/957,129

(22) Filed: Dec. 2, 2015

(65) Prior Publication Data

US 2016/0187840 A1 Jun. 30, 2016

(30) Foreign Application Priority Data

Dec. 26, 2014 (JP) ..... 2014-266138

(51) Int. Cl.
*G03G 21/16* (2006.01)
*G03G 21/18* (2006.01)

(52) U.S. Cl.
CPC ..... *G03G 21/1633* (2013.01); *G03G 21/1842* (2013.01); *G03G 21/1604* (2013.01); *G03G 2221/1696* (2013.01)

(58) Field of Classification Search
CPC ..... G03G 21/185
See application file for complete search history.

(56) References Cited

U.S. PATENT DOCUMENTS 7,076,189 B2 * 7/2006 Yoshino ..... G03G 15/161 399/121
7,127,195 B2 * 10/2006 Kimura ..... G03G 15/751 399/116
7,693,452 B2 * 4/2010 Kaiho ..... G03G 15/161 399/121
7,747,198 B2 * 6/2010 Nakagami ..... G03G 21/1832 399/258
8,045,885 B2 * 10/2011 Gunbe ..... G03G 21/185 399/113
8,290,396 B2 * 10/2012 Lee ..... G03G 21/1633 399/110
8,655,224 B2 * 2/2014 Yoshino ..... G03G 15/1605 399/110
2004/0131380 A1 7/2004 Kuma et al.
2009/0297238 A1 12/2009 Matsuura et al.
2011/0206432 A1 8/2011 Ninomiya et al.
2011/0229195 A1 9/2011 Matsuura
2012/0237251 A1 9/2012 Matsuura et al.
2013/0051828 A1 2/2013 Yogosawa et al.
2016/0026148 A1 * 1/2016 Kondo ..... G03G 21/168 399/121

FOREIGN PATENT DOCUMENTS

JP 2004-151389 5/2004
JP 2007-322678 12/2007

* cited by examiner

*Primary Examiner* — Clayton E LaBalle
*Assistant Examiner* — Leon W Rhodes, Jr.
(74) *Attorney, Agent, or Firm* — Oblon, McClelland, Maier & Neustadt, L.L.P.

(57) ABSTRACT

An image forming apparatus is provided. The image forming apparatus includes a main body; a first unit detachably attachable to the main body; a second unit which is arranged adjacent to the first unit and which is detachably attachable to the main body; and a cover which is located on the front side of the second unit relative to the detaching direction of the first and second units while supported by the second unit and which is openable and closable, wherein opening the cover permits detaching of the first unit from the main body and attaching of the first unit to the main body.

17 Claims, 7 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Application No. 2014-266138 filed on Dec. 26, 2014 in the Japan Patent Office, the entire disclosure of which is hereby incorporated by reference herein.

BACKGROUND

Technical Field

This disclosure relates to an image forming apparatus.

Description of the Related Art

In an image forming apparatus, plural functional units are generally arranged in the main body thereof. These functional units include a functional unit which can be detachably attachable to the main body so that adjustment or replacement of the unit can be easily performed.

In addition, in such an image forming apparatus, a cover to cover a functional unit from the outside thereof is often provided in the main body to separate the unit from another functional unit or to prevent scattering of dust from the unit. For example, an image forming apparatus is proposed, which includes an intermediate transfer unit and a photoconductor unit, which are functional units detachably attachable to the main body of the image forming apparatus, and a holder which serves as a cover pivotally supported by the main body of the image forming apparatus, wherein pivoting the holder so that the holder is moved from a position, at which the holder faces the functional units, in a detaching direction of the functional units makes it possible to detach or attach the functional units without interference.

SUMMARY

As an aspect of this disclosure, an image forming apparatus is provided which includes a main body, a first unit detachably attachable to the main body of the image forming apparatus, and a second unit which is arranged adjacent to the first unit and which is detachably attachable to the main body. The second unit has a cover which is arranged on a front side of the second unit relative to the detaching direction of the first and second units and which is openable and closable, and opening the cover permits detaching of the first unit from the main body and attaching of the first unit to the main body.

Alternative, an image forming apparatus is provided which includes a main body, a first unit detachably attachable to the main body, a second unit which is arranged adjacent to the first unit and which is detachably attachable to the main body, and a cover which is located on the front side of the second unit relative to the detaching direction of the first and second units while supported by the second unit. The cover is openable and closable, and opening the cover permits detaching of the first unit from the main body and attaching of the first unit to the main body.

The aforementioned and other aspects, features and advantages will become apparent upon consideration of the following description of the preferred embodiments taken in conjunction with the accompanying drawings.

DETAILED DESCRIPTION

In such a conventional image forming apparatus as mentioned above, the holder covering both the intermediate transfer unit and the photoconductor unit is constituted of one part while pivotally supported by the main body of the image forming apparatus. Therefore, the cover becomes large in size while having a heavy weight, and a member pivotally supporting the cover is required to have a rigidity (high strength). Therefore, the member supporting the cover also becomes large in size, and a space (hereinafter sometimes referred to as a layout space) is necessary for the member, thereby preventing downsizing of the image forming apparatus.

The object of this disclosure is to provide an image forming apparatus, which includes plural detachably attachable functional units and an openable and closable cover to cover the functional units and in which the main body thereof does not need a layout space for the cover.

Hereinafter, an image forming apparatus according to an embodiment of this disclosure will be described by reference to drawings.

Figure 1:
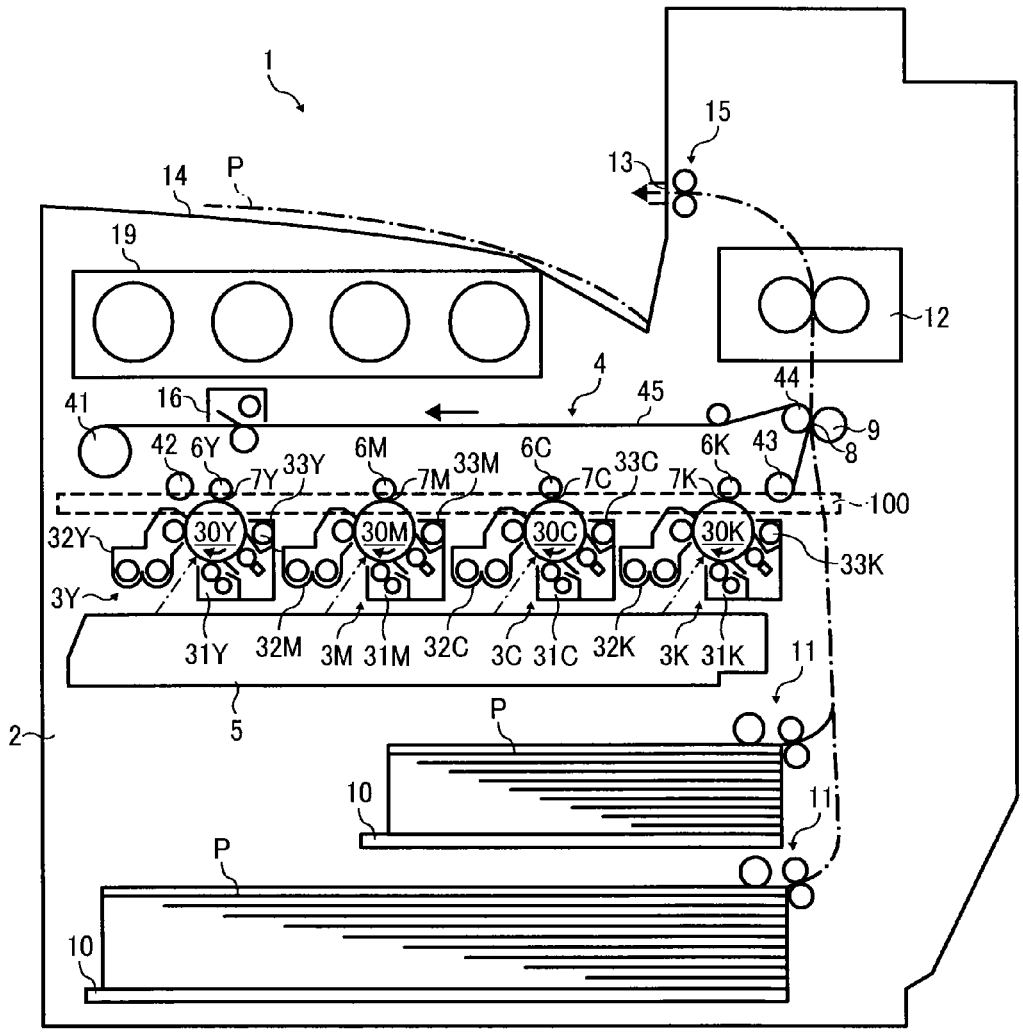
FIG. 1 is a schematic view illustrating an image forming apparatus according to an embodiment of this disclosure.

FIG. 1 illustrates a quadruplet tandem color printer 1, which is an example of the image forming apparatus and which is an intermediate transfer type printer forming a color image using yellow, magenta, cyan and black toners. In FIG. 1 (and other figures), characters Y, M, C and K are used as suffixes of constituents used for forming yellow, magenta, cyan and black images, respectively.

The color printer 1 includes a toner containing portion 19, which is arranged on an upper portion of a main body 2 (i.e., chassis) of the color printer at a front side 2A (illustrated in FIG. 2) of the main body and which includes four containers containing yellow, magenta, cyan and black toners (i.e., new toners) therein, respectively. In addition, four process cartridge units 3Y, 3M, 3C and 3K, which serve as an image forming portion and which form yellow, magenta, cyan and black toner images using the four color toners, respectively, and an intermediate transfer unit 4 are arranged in substantially a central portion of the main body 2. The four process cartridges 3Y, 3M, 3C and 3K are located below the intermediate transfer unit 4. Further, an optical unit 5 serving as an irradiator is arranged below the process cartridges 3Y, 3M, 3C and 3K.

The process cartridges 3Y, 3M, 3C and 3K include drum-shaped photoconductors 30Y, 30M, 30C and 30K, respectively, on which electrostatic latent images are formed by light beams emitted by the optical unit 5. Further, the process cartridges 3Y, 3M, 3C and 3K respectively include chargers 31Y, 31M, 31C and 31K to charge the photoconductors 30Y, 30M, 30C and 30*k*, respectively, developing devices 32Y, 32M, 32C and 32K to develop the electrostatic latent images on the photoconductors 30Y, 30M, 30C and 30*k*, respectively, cleaners 33Y, 33M, 33C and 33K to clean the surfaces of the photoconductors 30Y, 30M, 30C and 30*k*, respectively, and dischargers to remove residual charges from the photoconductors 30Y, 30M, 30C and 30*k*, respectively. These devices are arranged around the photoconductors 30Y, 30M, 30C and 30K, respectively. Thus, the process cartridges 3Y, 3M, 3C and 3K have a known configuration, and form yellow, magenta, cyan and black toner images on the photoconductors 30Y, 30M, 30C and 30K, respectively, by performing an electrophotographic image forming process.

The intermediate transfer unit 4 includes plural rollers 41, 42, 43 and 44 serving as rotation supporting members, and an endless transfer belt 45, which is looped over the four rollers. By rotating the roller 41, the transfer belt 45 is rotated counterclockwise as illustrated by an arrow.

Primary transfer rollers 6Y, 6M, 6C and 6K serving as primary transfer members are arranged inside the loop of the transfer belt 45 so as to face the photoconductors 30Y, 30M, 30C and 30K, respectively. The primary transfer rollers 6Y, 6M, 6C and 6K press the transfer belt 45 toward the photoconductors 30Y, 30M, 30C and 30K, respectively, to form primary transfer portions 7Y, 7M, 7C and 7K at which color toner images on the photoconductors 30Y, 30M, 30C and 30K are transferred to the transfer belt 45. Primary transfer biases are applied to the primary transfer portions 7Y, 7M, 7C and 7K, respectively.

A secondary transfer portion 8 is formed on a downstream side from the primary transfer portions 7Y, 7M, 7C and 7K relative to the belt feeding direction. The secondary transfer portion 8 is formed by the roller 44, and a secondary transfer roller 9, which is arranged so as to face the roller 44 while contacting the transfer belt 45, and a secondary transfer bias is applied to the secondary transfer portion 8.

Plural trays 10 and 10 each containing a bundle of recording sheets P are arranged below the optical unit 5. The recording sheets P in the tray 10 are fed one by one toward the secondary transfer portion 8 by a group of rollers 11.

At the secondary transfer portion 8, the color toner images, which have been transferred to the transfer belt 45 at the primary transfer portions 7Y, 7M, 7C and 7K, are transferred to the recording sheet P, thereby forming a combined color toner image on the recording sheet P. The recording sheet P bearing the combined color toner image thereon is fed to a fixing device 12 arranged on a downstream side from the secondary transfer portion 8 relative to the recording sheet feeding direction.

The fixing device 12 fixes the combined color toner image to the recording sheet P upon application of heat and pressure thereto, and feeds the recording sheet P bearing the fixed toner image toward an exit 13. The thus fed recording sheet P is ejected from the main body 2 by a pair of rollers 15 so as to be stacked on a sheet stacking tray 14.

After the transfer belt 45 transfers the toner images to the recording sheet P, the transfer belt 45 is cleaned by a belt clearer 16 so that foreign materials such as residual toners and paper dusts are removed therefrom.

Next, configuration of the characterizing portion of the image forming apparatus of this disclosure will be described.

Each of the process cartridge units 3Y, 3M, 3C and 3K is a unit having an image bearer (such as the photoconductor 30), i.e., a first unit of the image forming apparatus of this disclosure. The intermediate transfer unit 4 is a unit having an intermediate transfer medium (such as the transfer belt 45) facing the image bearers, i.e., a second unit of the image forming apparatus of this disclosure.

Figure 3:
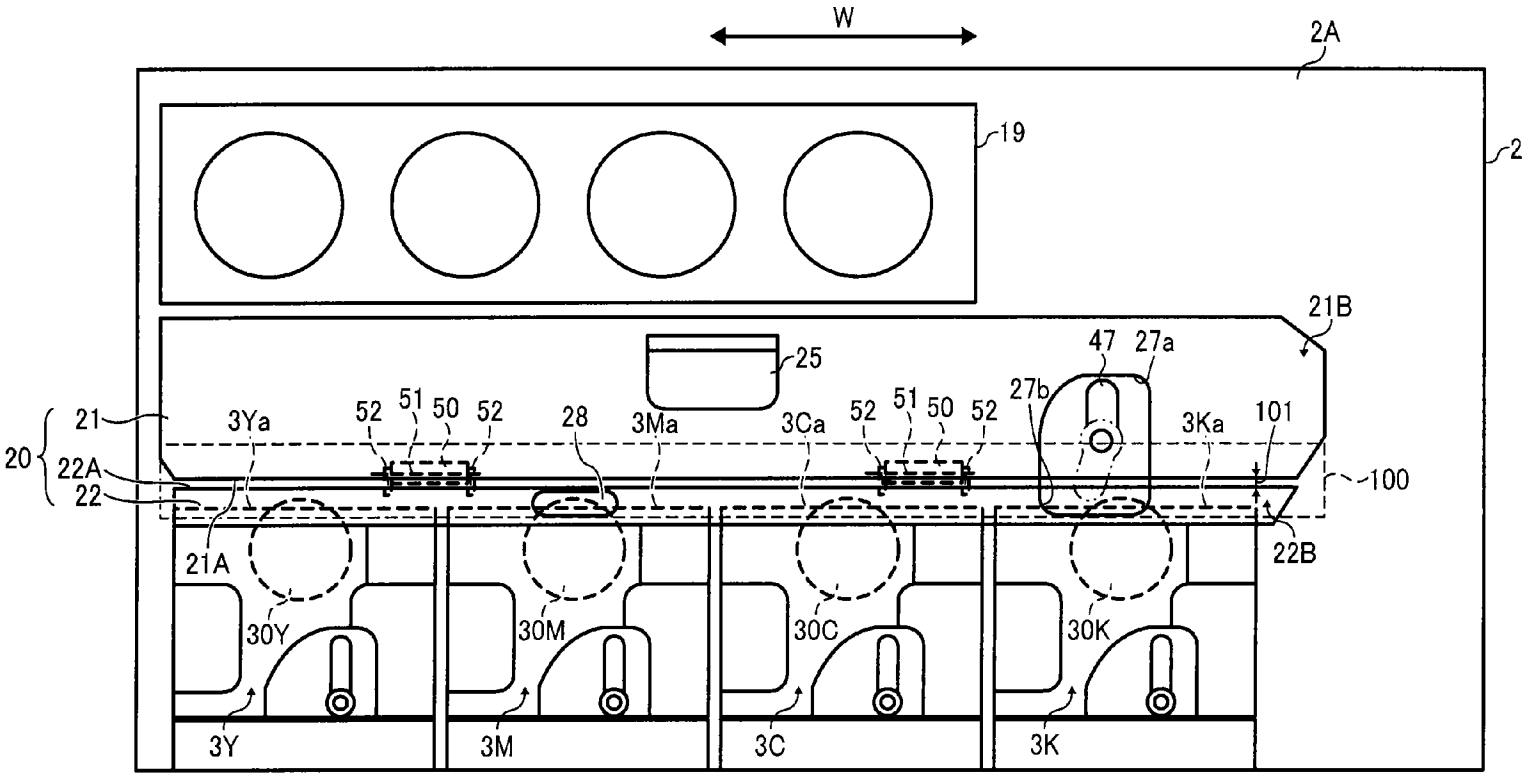
FIG. 3 is a front view illustrating the cover of the image forming apparatus.

The process cartridge units 3Y, 3M, 3C and 3K, and the intermediate transfer unit 4 are supported by the main body 2 in such a manner that the process cartridges can be slidably detached from and attached to the main body from the front side 2A of the main body 2. The process cartridge units 3Y, 3M, 3C and 3K, and the intermediate transfer unit 4 are arranged in the main body 2 so as to be adjacent to each other. As illustrated in FIG. 3, in this color printer 1, a space 101 is formed at a boundary portion 100 between upper portions 3Ya, 3Ma, 3Ca and 3Ka of the process cartridge units 3Y, 3M, 3C and 3K and the intermediate transfer unit 4 so that the process cartridge units 3Y, 3M, 3C and 3K and the intermediate transfer unit 4 are not contacted with each other (i.e., do not interfere with each other) when the process cartridge units and the intermediate transfer unit are attached to or detached from the main body 2.

Figure 4:
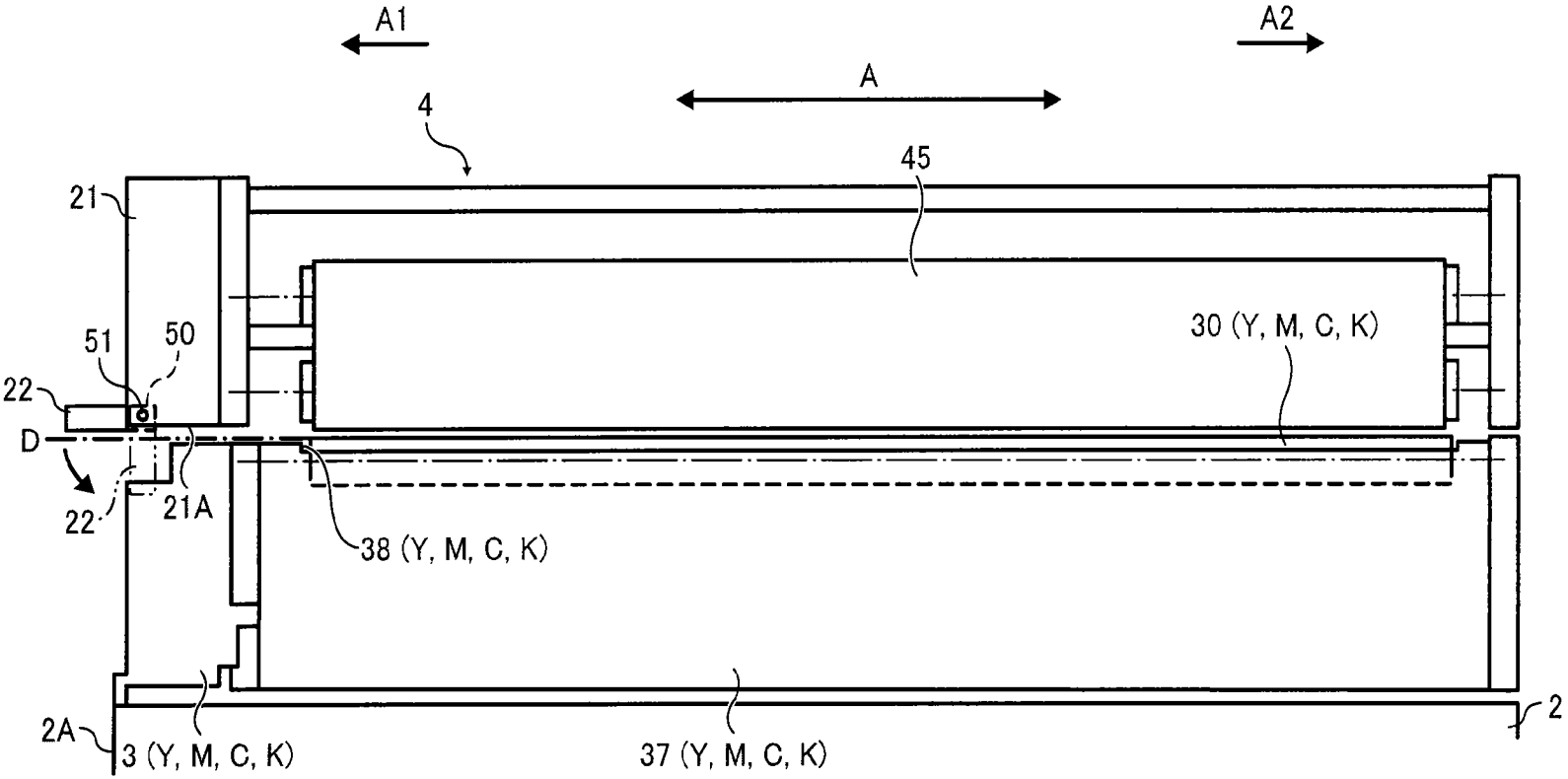
FIG. 4 is a side view illustrating a unit covered by the cover.

As illustrated in FIG. 4, the process cartridge units 3Y, 3M, 3C and 3K respectively have the photoconductors 30Y, 30M, 30C and 30K, and cases 37Y, 37M, 37C and 37K, which respectively hold the photoconductors 30Y, 30M, 30C and 30K. The cases 37Y, 37M, 37C and 37K respectively have openings 38Y, 38M, 38C and 38K on upper portions thereof, from which parts of the peripheral surfaces of the photoconductors 30Y, 30M, 30C and 30K are exposed to the outside.

Namely, at the boundary portion 100, parts of the peripheral surfaces of the photoconductors 30Y, 30M, 30C and 30K are exposed to the outside of the units 3Y, 3M, 3C and 3K. The intermediate transfer unit 4 is arranged so that the transfer belt 45 faces the photoconductors 30Y, 30M, 30C and 30K at the boundary portion 100. Namely, as illustrated in FIG. 1, the primary transfer portions 7Y, 7M, 7C and 7K are arranged at the boundary portion 100.

Conventional image forming apparatus typically have a configuration such that one cover, which is supported by the main body, covers both of an intermediate transfer unit and a process cartridge unit. In this case, the cover becomes large in size, and in addition a pivot supporting portion pivotally supporting the cover is required to have a rigidity and high strength, resulting in enlargement of the pivot supporting portion. Therefore, it is necessary to provide a layout space for the pivot supporting portion at the main body side. In addition, the pivot supporting portion needs a hinge or the like to pivotally support the cover, and therefore the image forming apparatus becomes large in size, i.e., the image forming apparatus cannot be downsized.

There is an image forming apparatus in which one cover is provided on one of an intermediate transfer unit and a process cartridge unit to cover both the units. In this case, when the unit on which the cover is not provided is attached to or detached from the main body, it is necessary to detach the other unit, on which the cover is provided, from the main body or to remove the cover from the other unit. Therefore, the unit replacement operation is troublesome in the image forming apparatus.

Figure 2:
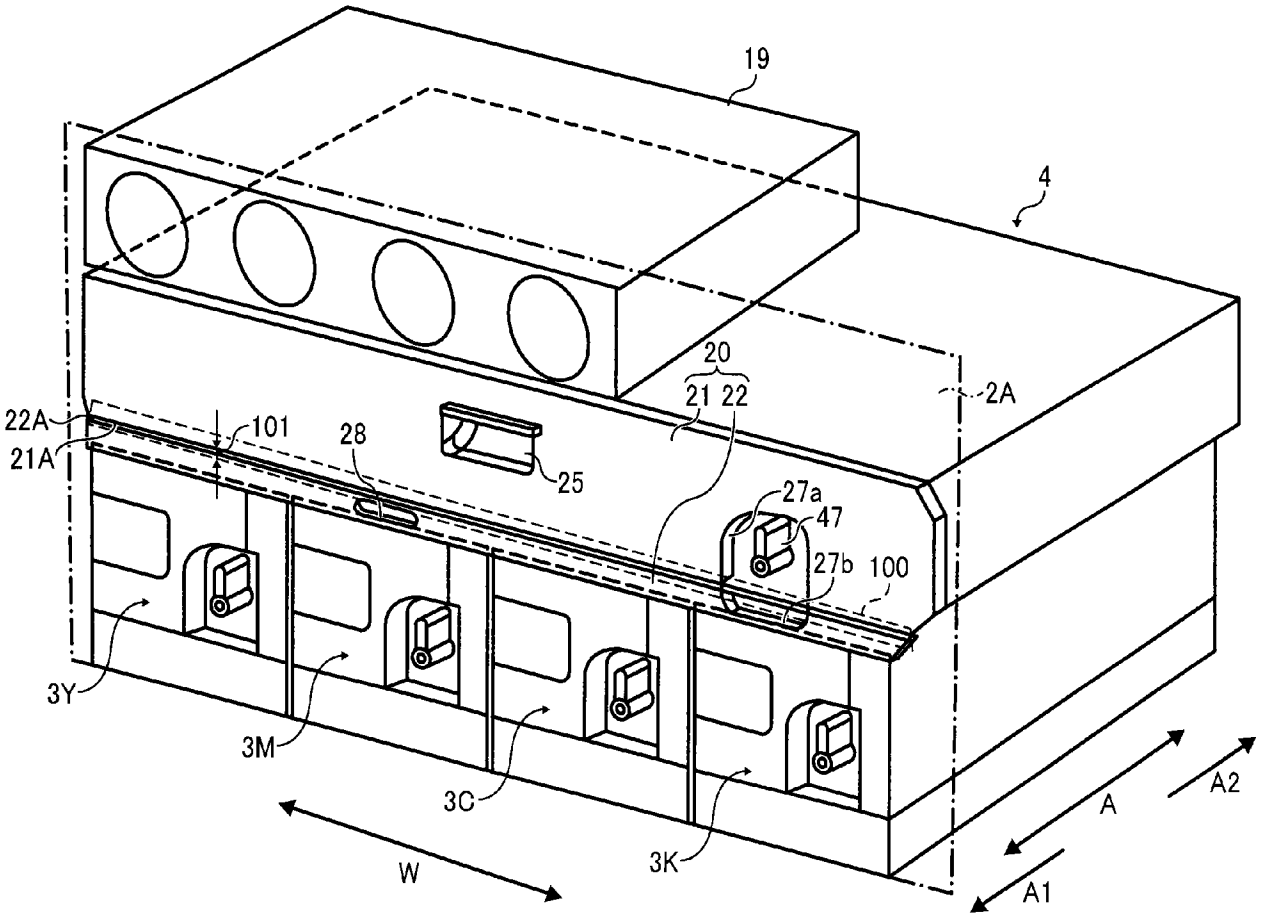
FIG. 2 is a perspective view illustrating a cover of the image forming apparatus illustrated in FIG. 1.

Therefore, as illustrated in FIG. 2, the printer 1 of this disclosure has a cover 20, which is arranged on a front side of the printer relative to a detaching direction A1 of the process cartridge units 3Y, 3M, 3C and 3K and the intermediate transfer unit 4 in such a manner as to face the intermediate transfer unit 4. Namely, the cover 20 is arranged on the front side of the intermediate transfer unit 4 relative to the detaching direction A1. In FIG. 2, the arrow A1 indicates the detaching direction of the process cartridge units 3Y, 3M, 3C and 3K and the intermediate transfer unit 4, and an arrow A2 indicates an attaching direction of the process cartridge units and the intermediate transfer unit. In addition, an arrow A indicates attaching and detaching directions of the process cartridge units 3Y, 3M, 3C and 3K and the intermediate transfer unit 4, and an arrow W indicates a width direction of the main body 2 of the printer 1. Thus, the intermediate transfer unit 4 having a length in the direction W has the cover 20 on the front side thereof relative to the detaching direction A1.

As illustrated in FIG. 3, the cover 20 includes a first covering member 21, and a second covering member 22 facing the boundary portion 100 between the process cartridge units 3Y, 3M, 3C and 3K and the intermediate transfer unit 4. The first covering member 21 is fixed to the intermediate transfer unit 4 so as to be integrated, and therefore the first covering member is one constituent of the intermediate transfer unit 4.

In contrast, the second covering member 22 is arranged so as to face the boundary portion 100, and extends downward so as to face parts (i.e., upper portions) of the process cartridge units 3Y, 3M, 3C and 3K when the second covering member 22 is observed from the front side 2A of the printer 1. Therefore, the second covering member 22 is supported by a lower portion 21A of the first covering member 21 in an openable and closable manner so that when the second covering member 22 achieves the opened state, the process cartridge units 3Y, 3M, 3C and 3K can be attached to and detached from the main body 2. As illustrated in FIG. 2, the lower portion 21A of the first covering member 21 faces an upper portion 22A of the second covering member 22. As illustrated in FIGS. 3 and 4, the upper portion 22A of the second covering member 22, which portion is closer to the process cartridge units 3Y, 3M, 3C and 3K (i.e., the first unit) than the lower portion 21A of the second covering member 21, can be pivoted (opened and closed).

The first covering member 21 has a handle 25, by which the intermediate transfer unit 4 can be attached to or detached from the main body 2 and which is arranged at a position such that the handle 25 does not interfere with opening and closing of the second covering member 22. As illustrated in FIGS. 2 and 3, the handle 25 is formed on a surface 21B, which is a front surface of the first covering member 21 relative to the detaching direction A1, while concaved in the attaching direction A2.

The second covering member 22 has a handle 28, by which the second covering member 22 can be opened when at least one of the process cartridge units 3Y, 3M, 3C and 3K is attached to or detached from the main body 2. The handle 28 is formed on a surface 22B, which is a front surface of the second covering member 22 relative to the detaching direction A1, while concaved in the attaching direction A2.

As illustrated in FIG. 2, the intermediate transfer unit 4 has a recessed portion 27*a* on the first covering member 21 to accommodate an operating lever 47, which is used for contacting the transfer belt 45 with the photoconductors 30Y, 30M, 30C and 30K or separating the transfer belt from the photoconductors. In addition, the second covering member 22 has a recessed portion 27*b*, which is communicated with the recessed portion 27*a* when the second covering member 22 is in the closed state.

When the operating lever 47 is positioned as illustrated by a solid line in FIG. 3, the operating lever 47 has a release position at which the intermediate transfer unit 4 can be attached to or detached from the process cartridge units 3Y, 3M, 3C and 3K. When the operating lever 47 is positioned as illustrated by a chain double-dashed line in FIG. 3, the operating lever 47 has a lock position at which the second covering member 22 is held by the lever so that the second covering member 22 cannot be opened or closed.

Figure 5:
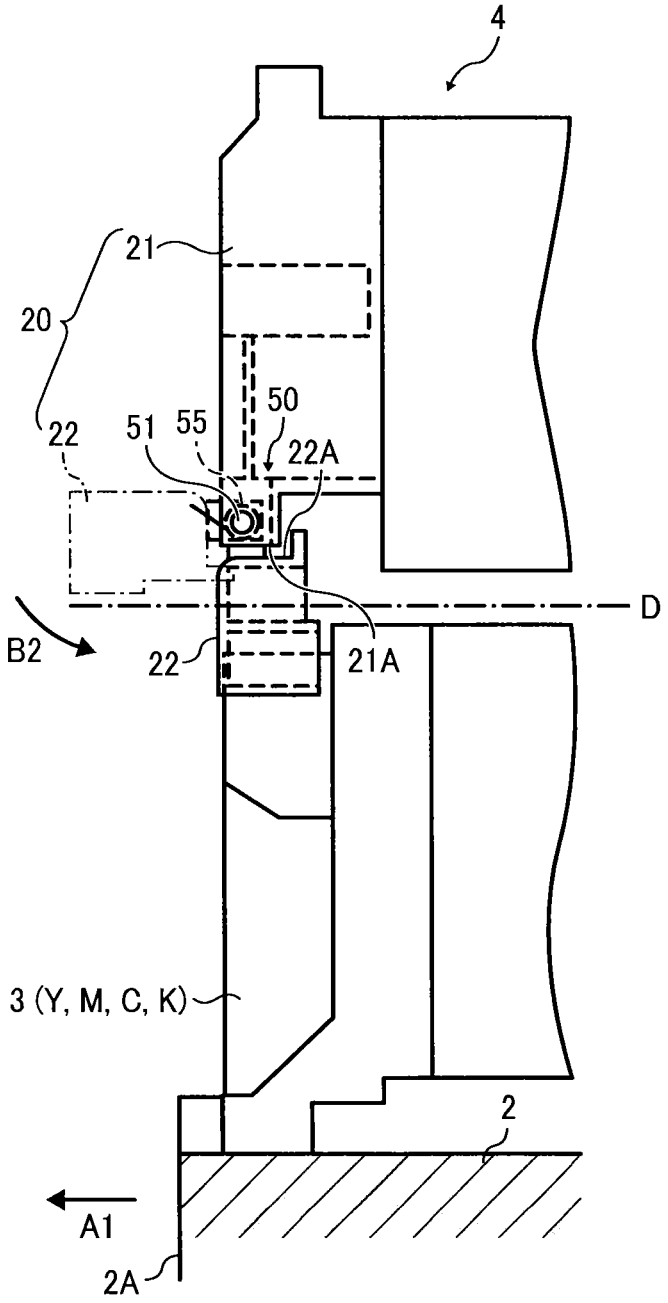
FIG. 5 is an enlarged view illustrating the cover which achieves a closed state.
Figure 6:
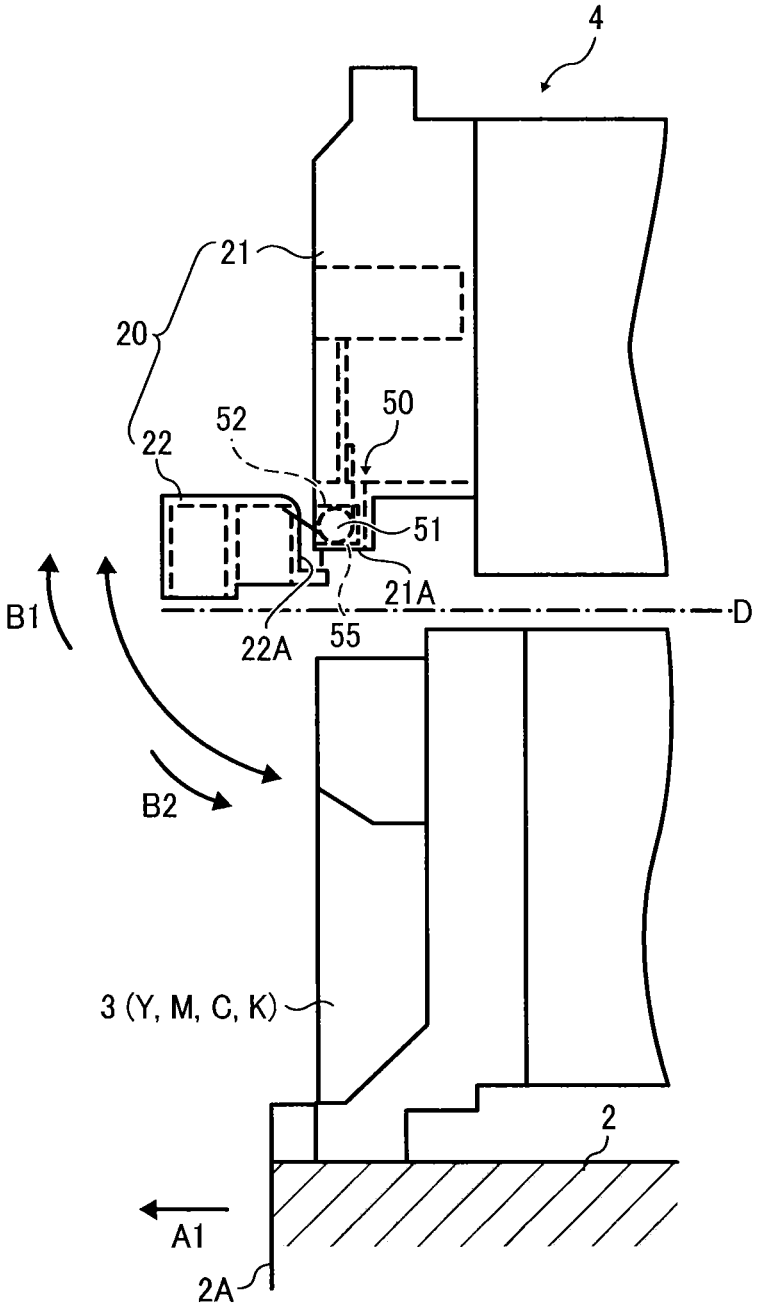
FIG. 6 is an enlarged view illustrating the cover which achieves an opened state.

As illustrated in FIGS. 5 and 6, the upper portion 22A of the second covering member 22 is attached to the lower portion 21A of the first covering member 21 in an openable and closable manner. In addition, the lower portion 21A has two pivot supporting members 50, which are arranged so as to extend in the direction W while separated from each other as illustrated in FIG. 3. Further, the second covering member 22 has supporting members 52, which are arranged so as to extend in the direction W while separated from each other and which are connected with each of the pivot supporting members 50 via a pin 51 extending in the direction W. Since the supporting members 52 of the second covering member 22 are connected with the pivot supporting members 50 via the pin 51, the second covering member 22 is pivotally supported by the first covering member 21 (i.e., the intermediate transfer unit 4). As illustrated in FIG. 4, the second covering member 22 can be pivoted to a position upper than a moving path D of the uppermost portion of the process cartridge units 3Y, 3M, 3C and 3K when the process cartridge units are attached to or detached from the main body 2. Namely, as illustrated in FIG. 6, the second covering member 22 achieves the opened state when the second covering member 22 is pivoted to the position upper than the moving path D. In contrast, as illustrated in FIG. 5, the second covering member 22 achieves the closed state when the second covering member 22 is pivoted so as to intersect the moving path D. In FIGS. 5 and 6, an arrow B1 indicates the opening direction of the second covering member 22, and an arrow B2 indicates the closing direction of the second covering member 22. Namely, the second covering member 22 is connected with the first covering member 21 (i.e., the intermediate transfer unit 4) so as to be pivoted in the opening direction B1 and the closing direction B2. In addition, a coil spring 55, which is a biasing device to bias the second covering member 22 toward the opening direction B1, is attached to the pin 51 of each of the pivot supporting members 50.

Thus, the color printer 1 has the process cartridge units 3Y, 3M, 3C and 3K, the intermediate transfer unit 4 which is arranged adjacent to the process cartridge units and which can be attached to or detached from the main body 2 of the color printer 1, and the openable and closable second covering member 22 which is arranged on the front side of the main body 2 relative to the unit detaching direction A1, wherein when the second covering member 22 achieves the opened state, the process cartridge units can be attached to or detached from the main body 2. Therefore, a layout space for the cover is not necessary for the main body 2 of the color printer 1, thereby making it possible to prevent the color printer 1 from becoming large in size.

Specifically, when the second covering member 22 achieves the closed state (i.e., when the second covering member 22 faces the boundary portion 100 as illustrated in FIG. 5), the second covering member 22 faces the process cartridge units 3Y, 3M, 3C and 3K while being pivotally supported by the intermediate transfer unit 4. Therefore, an operator can easily replace one or more of the process cartridge units 3Y, 3M, 3C and 3K with one or more new process cartridges, by moving the operating lever 47 from the lock position to the release position, and then pivoting the second covering member 22 in the opening direction B1 using the handle 28.

The second covering member 22 is arranged on the front side of the main body 2 (i.e., the front side of the process cartridge units 3Y, 3M, 3C and 3K, and the intermediate transfer unit 4) relative to the detaching direction A1 of the process cartridge units and the intermediate transfer unit.

Thus, the opening/closing operation position at which the second covering member 22 is opened or closed can be set so as to be close to the attaching/detaching operation position at which the process cartridge units 3Y, 3M, 3C and 3K are attached to or detached from the main body 2. Therefore, the color printer 1 has good operability.

The second covering member 22 is biased in the opening direction B1 by the coil spring 55. Therefore, when the operating lever 47, which locks the second covering member 22 in the closed position, is moved to the release position, the second covering member 22 is moved in the opening direction B1 so as to have the release position by the spring force of the coil spring 55. Therefore, when the process cartridge units 3Y, 3M, 3C and 3K are attached to or detached from the main body 2, it is not necessary for the operator to hold the second covering member 22 to the release position, resulting in enhancement of the operability of the printer 1 in the unit attaching/detaching operation.

The cover 20 is separated into the first covering member 21, which is fixed to the intermediate transfer unit 4, and the second covering member 22, which is arranged so as to be pivoted relative to the first covering member 21. In addition, when the moving angle of the second covering member 22 in the direction B1 is lower than 90°, the process cartridge units 3 can be detached or attached. Namely, the stroke (moving angle) of the cover in the direction B1 or B2 is smaller in this printer 1 than that in conventional image forming apparatus in which both of process cartridge units and an intermediate transfer unit are covered with one cover and the cover has to be moved at an angle of not less than 90° to detach or attach the units. In addition, since the size of the cover is smaller in this printer 1 than that in such conventional image forming apparatus, it is not necessary to use a material having high rigidity and strength (i.e., a material having large in size) for the pivot supporting member 50, and therefore it becomes unnecessary to form a layout space for the pivot supporting member, thereby preventing the printer 1 from becoming large in size. Further, the number of parts used for the cover can be decreased in the image forming apparatus of this disclosure, and therefore costs of the image forming apparatus can be reduced.

Further, since the stroke of the cover of this printer 1 is relatively small compared to that of such conventional image forming apparatus as mentioned above, the printer 1 hardly causes a problem in that foreign materials such as scattered toners and paper dust in the main body are scattered from the main body when the cover is opened to replace the process cartridge units and the intermediate transfer unit, although the conventional image forming apparatus often causes the problem. Furthermore, dirt of the inside of the printer and the backside of the cover is not noticeable, and therefore the printer looks good.

Since the cover 20, which includes the first and second covering members 21 and 22, is integrated with the intermediate transfer unit 4, replacement of the cover 20 can be performed together with replacement of the intermediate transfer unit 4.

In addition, since the handle 25 is provided on the first covering member 21 (i.e., on the intermediate transfer unit 4), an operator can easily detach the intermediate transfer unit 4 from the main body 2, resulting in enhancement of the unit replacement operability of the printer.

Figure 7:
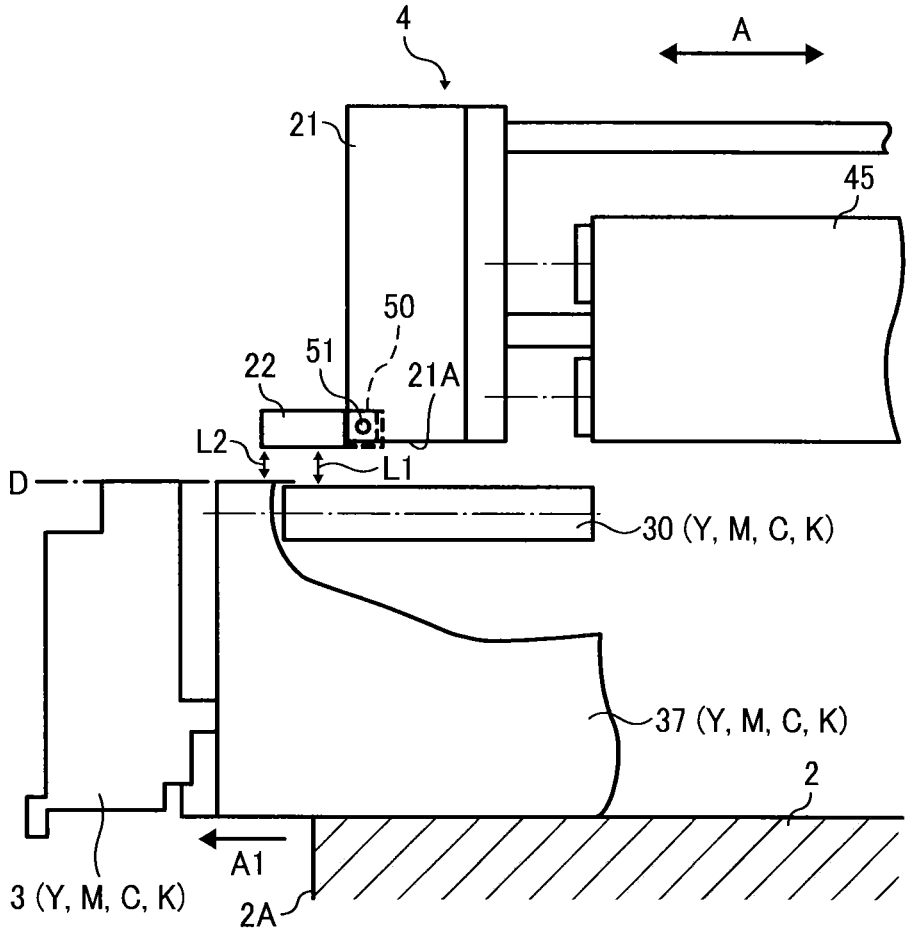
FIG. 7 is an enlarged view for describing the distance relationship among the cover, an image bearer, and a case (housing) of the image bearer.

When the second covering member has the opened position as illustrated in FIG. 6, a distance L1 (illustrated in FIG. 7) between the uppermost peripheral portion of each of the photoconductors 30Y, 30M, 30C and 30K, which portion is exposed to the outside, and the second covering member 22, is longer than a distance L2 (illustrated in FIG. 7) between the upper surface of each of the cases 37Y, 37M, 37C and 37K of the process cartridge units 3Y, 3M, 3C and 3K, and the second covering member 22. Therefore, even when the second covering member 22 is moved in the direction B2, for example, due to malfunction of the coil spring 55, the second covering member 22 contacts the upper surfaces of the cases 37Y, 37M, 37C and 37K without contacting the photoconductors 30Y, 30M, 30C and 30K. Therefore, the photoconductors 30Y, 30M, 30C and 30K are prevented from breakage.

Hereinbefore, preferred embodiments of the image forming apparatus of this disclosure have been described. However, this disclosure is not limited thereto, and additional modifications and variations are possible in light of the above teachings. It is therefore to be understood that within the scope of the appended claims the invention may be practiced other than as specifically described herein.

For example, the image forming apparatus of this disclosure is not limited to a color printer, and can be a copier, a facsimile, a plotter printer, a multifunction peripheral having two or more of printing, facsimileing, plotter-printing, and copying functions, or the like.

In this printer 1, the second covering member 22 is pivotally supported by the intermediate transfer unit 4 (the first covering member 21) to achieve the opened and closed states. However, the second covering member 22 may be slidably supported by the intermediate transfer unit 4 (the first covering member 21) to achieve the opened and closed states.

In addition, in this printer 1, the process cartridge units 3Y, 3M, 3C and 3K are arranged below the intermediate transfer unit 4, and therefore the primary transfer portions 7Y, 7M, 7C and 7K are located below the intermediate transfer unit 4. However, the layout is not limited thereto, and, for example, the process cartridges 3 and the primary transfer portions 7 can be located above the intermediate transfer unit 4.

Further, in this printer 1, the cover 20 (the first covering member 21) is fixed to the intermediate transfer unit 4, and a portion of the cover (i.e., the second covering member 22) facing the process cartridge units 3Y, 3M, 3C and 3K, and the boundary portion 100 between the intermediate transfer unit 4 and the process cartridges is openable and closable. However, the configuration is not limited thereto, and, for example, the cover can be fixed to the process cartridges 3 while a portion of the cover facing the boundary portion 100 and the intermediate transfer unit 4 is openable and closable.

Hereinbefore, an image forming apparatus using an intermediate transfer method in which an image is transferred from the transfer belt 45 to the recording sheet P has been described. However, the image forming apparatus of this disclosure is not limited thereto. For example, the image forming apparatus can be an image forming apparatus using a direct transfer method in which an image formed on a drum-shaped or belt-shaped photoconductor is directly transferred to a recording sheet.

In this printer 1, the recording sheet P is fed in the horizontal direction at the primary transfer portions. However, the sheet feeding direction is not limited thereto, and can be an upward direction, a downward direction, an obliquely upward direction or an obliquely downward direction. Specifically, the image forming apparatus of this disclosure can have configurations such that the transfer belt 45 of the intermediate transfer unit 4 is moved vertically (i.e., upward and downward), and the process cartridges 3Y, 3M, 3C and 3K are arranged on the right (or left) side of the intermediate transfer unit 4 so that the primary transfer portions 7Y, 7M, 7C and 7K are located on the right (or left) side of the intermediate transfer unit 4. In addition, the image forming apparatus of this disclosure can have configurations such that the intermediate transfer unit 4 is arranged such that the transfer belt 45 is moved obliquely vertically (i.e., in the obliquely upward and downward directions) while the process cartridges 3Y, 3M, 3C and 3K are arranged such that the primary transfer portions 7Y, 7M, 7C and 7K are formed on the right side, the left side, the obliquely upward side or the obliquely downward side.

In this printer 1, the first covering member 21 is fixed to the intermediate transfer unit 4. However, the image forming apparatus of this disclosure can have a configuration such that only the openable and closable second covering member 22 is used without using the first covering member 21, and the second covering member is attached to the intermediate transfer unit 4.

The effects described above for various examples are the most proper effects produced by the examples, and the effects of the image forming apparatus of this disclosure are not limited thereto.

Effect of this Disclosure

The image forming apparatus of this disclosure includes a main body, a first unit (such as the process cartridge units) detachably attachable to the main body, and a second unit (such as the intermediate transfer unit) which is arranged adjacent to the first unit and which is detachably attachable to the main body. The second unit (or the image forming apparatus) has a cover, which is arranged on the front side of the second unit relative to the detaching direction of the first and second units and which is openable and closable, and opening the cover permits detaching of the first unit from the main body and attaching of the first unit to the main body. Therefore, it is not necessary for the main body of the image forming apparatus to have a layout space for the cover, thereby preventing the image forming apparatus from becoming large in size.

What is claimed is:

1. An image forming apparatus comprising:

a main body;

a process cartridge detachably attachable to the main body and including an image bearer to bear an image thereon; and an intermediate transfer unit which is arranged adjacent to the process cartridge and which is detachably attachable to the main body, the intermediate transfer unit including an intermediate transfer medium which faces the image bearer to receive the image from the image bearer, wherein the intermediate transfer unit includes:

a cover which is attached to the intermediate transfer unit and located on a front side of the intermediate transfer unit relative to a detaching direction of the process cartridge and the intermediate transfer unit and which is openable and closable, wherein opening the cover exposes a gap between the image bearer and the intermediate transfer medium, and permits detaching of the process cartridge from the main body and attaching of the process cartridge to the main body, and wherein closing the cover covers the gap from the front side of the intermediate transfer unit.

2. The image forming apparatus according to claim 1, wherein the cover is located closer to the process cartridge than to the intermediate transfer unit.

3. The image forming apparatus according to claim 1, wherein the intermediate transfer unit includes:

a handle for use in detaching or attaching of the intermediate transfer unit, wherein the handle is located at a position so as not to interfere with opening and closing of the cover.

4. The image forming apparatus according to claim 1, further comprising:

a biasing device to bias the cover in an opening direction of the cover.

5. The image forming apparatus according to claim 1, wherein the process cartridge includes:

a case to support the image bearer, wherein when the cover is opened, the cover is closer to the case than to the image bearer.

6. The image forming apparatus according to claim 1, wherein the intermediate transfer medium faces the image bearer to receive the image from the image bearer when the process cartridge and the intermediate transfer unit are attached to the main body.

7. The image forming apparatus according to claim 1, comprising a plurality of the process cartridges, wherein opening the cover exposes all the gaps between each of the image bearers and the intermediate transfer medium, and wherein closing the cover covers all the gaps.

8. The image forming apparatus according to claim 1, wherein the intermediate transfer unit includes an operating lever to contact the image bearer with the intermediate transfer medium and separate the intermediate transfer medium from the image bearer.

9. The image forming apparatus according to claim 8, wherein the operating lever regulates opening the cover when the image bearer contacts the intermediate transfer medium and the operating lever allows opening the cover when the intermediate transfer medium is separated from the image bearer.

10. The image forming apparatus according to claim 1, wherein the process cartridge is detachable in an axial direction of the image bearer and the intermediate transfer unit is detachable in a width direction of the intermediate transfer medium.

11. An image forming apparatus comprising:

a main body;

a process cartridge detachably attachable to the main body;

an intermediate transfer unit which is arranged adjacent to the process cartridge and which is detachably attachable to the main body, the intermediate transfer unit including an intermediate transfer medium which faces the image bearer to receive the image from the image bearer; and a cover which is located on a front side of the intermediate transfer unit relative to a detaching direction of the process cartridge and the intermediate transfer unit while supported by the intermediate transfer unit and which is openable and closable, wherein opening the cover exposes a gap between the image bearer and the intermediate transfer medium, and permits detaching of the process cartridge from the main body and attaching of the process cartridge to the main body, and wherein closing the cover covers the gap from the front side of the intermediate transfer unit.

12. The image forming apparatus according to claim 11, wherein the cover includes:

an openable and closable portion, wherein the openable and closable portion is located closer to the process cartridge than to the intermediate transfer unit, and wherein opening the openable and closable portion permits detaching of the process cartridge from the main body and attaching of the process cartridge to the main body.

13. The image forming apparatus according to claim 11, wherein the cover includes:

a first covering member mounted on the intermediate transfer unit; and a second covering member located so as to face a boundary portion between the process cartridge and the intermediate transfer unit, wherein the second covering member is mounted on the first covering member in an openable and closable manner, and wherein opening the second covering member permits detaching of the process cartridge from the main body and attaching of the process cartridge to the main body.

14. The image forming apparatus according to claim 13, wherein the first covering member includes:

a handle for use in detaching or attaching of the intermediate transfer unit, wherein the handle is located at a position so as not to interfere with opening and closing of the second covering member.

15. The image forming apparatus according to claim 13, further comprising:

a biasing device to bias the second covering member in an opening direction of the second covering member.

16. The image forming apparatus according to claim 11, wherein the process cartridge includes:

a case to support the image bearer, wherein when the cover is opened, the cover is closer to the case than to the image bearer.

17. The image forming apparatus according to claim 11, wherein the intermediate transfer medium which faces the image bearer to receive the image from the image bearer when the process cartridge and the intermediate transfer unit are attached to the main body.

* * * * *